US008656721B2

(12) United States Patent
Matsumoto et al.

(10) Patent No.: US 8,656,721 B2
(45) Date of Patent: Feb. 25, 2014

(54) GAS TURBINE COMBUSTOR INCLUDING SEPARATE FUEL INJECTORS FOR PLURAL ZONES

(75) Inventors: Kiyoshi Matsumoto, Kobe (JP); Takeo Oda, Kobe (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 993 days.

(21) Appl. No.: 12/659,527

(22) Filed: Mar. 11, 2010

(65) Prior Publication Data

US 2010/0229557 A1 Sep. 16, 2010

(30) Foreign Application Priority Data

Mar. 13, 2009 (JP) ..... 2009-60524

(51) Int. Cl.
*F02C 1/00* (2006.01)

(52) U.S. Cl.
USPC ..... 60/733; 60/746

(58) Field of Classification Search
USPC ..... 60/733, 737, 739, 746
See application file for complete search history.

(56) References Cited

U.S. PATENT DOCUMENTS

| | | | | |
|---|---|---|---|---|
| 3,872,664 | A * | 3/1975 | Lohmann et al. | 60/746 |
| 5,490,380 | A * | 2/1996 | Marshall | 60/776 |
| 5,657,632 | A * | 8/1997 | Foss | 60/742 |
| 5,687,571 | A * | 11/1997 | Althaus et al. | 60/737 |
| 5,749,219 | A | 5/1998 | DuBell | |
| 5,950,417 | A * | 9/1999 | Robertson et al. | 60/776 |
| 6,161,387 | A | 12/2000 | Green | |
| 6,189,814 | B1 * | 2/2001 | Richards | 239/434 |
| 6,253,555 | B1 * | 7/2001 | Willis | 60/737 |
| 6,481,209 | B1 * | 11/2002 | Johnson et al. | 60/746 |
| 6,530,223 | B1 * | 3/2003 | Dodds et al. | 60/746 |
| 6,536,216 | B2 * | 3/2003 | Halila et al. | 60/737 |
| 6,735,949 | B1 * | 5/2004 | Haynes et al. | 60/746 |
| 8,172,568 | B2 * | 5/2012 | Kashihara et al. | 431/285 |
| 8,272,219 | B1 * | 9/2012 | Johnson et al. | 60/746 |

FOREIGN PATENT DOCUMENTS

| | | |
|---|---|---|
| EP | 2 206 963 A2 | 7/2010 |
| GB | 2 073 400 A | 10/1981 |
| JP | A-04-148113 | 5/1992 |
| JP | A-8-261468 | 10/1996 |
| JP | A-10-196909 | 7/1998 |

(Continued)

OTHER PUBLICATIONS

Extended European Search Report issued in European Application No. 10156222.1 dated Mar. 28, 2011.

(Continued)

*Primary Examiner* — William H Rodriguez
(74) *Attorney, Agent, or Firm* — Oliff PLC

(57) ABSTRACT

This invention provides a gas turbine combustor including: a main burner at a head portion of a combustor cylinder; and a pre-mixing type supplemental burner at a downstream portion of the combustor cylinder and extending through a circumferential wall thereof. The supplemental burner includes: an introducing passage configured to deflect a part of the compressed air radially inward, the compressed air flowing from an air passage between the circumferential wall of the combustor cylinder and a housing surrounding the circumferential wall toward the head portion of the combustor cylinder, and introduce the compressed air into the combustor cylinder; and a fuel nozzle configured to supply the fuel from fuel injection holes to the compressed air introduced into the introducing passage to produce a pre-mixed gas in the introducing passage.

6 Claims, 12 Drawing Sheets

(56) References Cited

FOREIGN PATENT DOCUMENTS

| | | |
|---|---|---|
| JP | A-2000-356315 | 12/2000 |
| JP | A-2006-010193 | 1/2006 |
| JP | A-2007-232234 | 9/2007 |

OTHER PUBLICATIONS

Japanese Office Action issued in Japanese Application No. 2009-060524 dated Feb. 22, 2011 (with translation).

* cited by examiner

GAS TURBINE COMBUSTOR INCLUDING SEPARATE FUEL INJECTORS FOR PLURAL ZONES

CROSS REFERENCE TO RELATED APPLICATIONS

This application is based upon and claims the benefit of priority from the prior Japanese Patent Application No. 2009-60524 filed on Mar. 13, 2009, the entire contents of which are incorporated herein by reference.

BACKGROUND OF THE INVENTION

1. Field of the Invention

The present invention relates to a gas turbine combustor which can suppress the amount of nitrogen oxides (hereinafter referred to as "NOx") discharged from the combustor, even when the combustor is operated with a relatively high load or intensity.

2. Background Art

For the gas turbine apparatus, a highly strict environmental standard is established on the composition of exhaust gas discharged from the turbine upon the operation thereof. Especially, in this standard, substantial reduction of the discharge amount of NOx contained in the exhaust gas is required. In the past, as one approach for reducing the discharge amount of NOx in regard to the gas turbine apparatus, a method for lowering the temperature of the combustion flame by injecting water or steam into the combustion chamber has been employed. With this method, however, the thermal efficiency of the apparatus may tend to be degraded, and/or life span of the apparatus may be shortened due to corrosion of the turbine caused by poor quality of the water used. In order to solve such problems, one gas turbine apparatus employing a DLE (Dry Low Emission) type combustor, intended for reducing the discharge amount of NOx, without using the water and/or steam, has been developed in recent years. The gas turbine apparatus of this type includes an additional pre-mixing type supplemental burner provided to a downstream portion of a combustor cylinder of the DLE combustor. With this configuration, fuel can be further supplied by the supplemental burner, in a state in which the fuel that is not yet combusted is no longer discharged or detected from an upstream region of the combustor. In this way, the amount of NOx discharged from the turbine can be substantially reduced (see Patent Documents 1, 2).

PATENT DOCUMENTS

Patent Document 1: JP 8-261468 A

Patent Document 2: JP 10-196909 A

However, the supplemental burner as disclosed in the above Patent Documents 1, 2 has a rather long pre-mixing duct extending from the upstream portion of the combustor cylinder of the DLE combustor to air ports used for the supplemental burner of the combustor cylinder. Therefore, such a structure should be large-sized, thus substantially enlarging the combustor itself as well as inevitably increasing the number of components and man-hour required for construction, leading to undue increase of the cost.

SUMMARY OF THE INVENTION

Therefore, it is an object of the present invention to provide a new gas turbine combustor which can substantially reduce the discharge amount of NOx with a compact structure achieved by provision of the pre-mixing type supplemental burner in a significantly compact form without requiring undue increase of the size and cost of the combustor.

In order to achieve the above object, the present invention is a gas turbine combustor adapted for combusting a fuel together with a compressed air supplied from a compressor and supplying a combustion gas to a turbine, including: a main burner provided to a head portion of a combustor cylinder constituting a combustion chamber; and a pre-mixing type supplemental burner provided to a downstream portion of the combustor cylinder relative to the main burner and extending through a circumferential wall of the combustor cylinder, wherein the supplemental burner includes: an introducing passage configured to deflect a part of the compressed air radially inward with respect to the combustor cylinder, the compressed air flowing from an air passage formed between the circumferential wall of the combustor cylinder and a housing surrounding the circumferential wall toward the head portion of the combustor cylinder, and introduce the compressed air into the combustor cylinder; and a fuel nozzle configured to supply the fuel from a plurality of fuel injection holes to the compressed air which is introduced into the introducing passage so as to produce a pre-mixed gas in the introducing passage.

As used herein, the "downstream" portion of the combustor cylinder means the "downstream" portion of the combustor cylinder when seen along the flow direction of combustion gas.

In this configuration, the supplemental burner is provided to the downstream portion of the combustion cylinder relative to the main burner located at the head portion of the combustion cylinder, such that part of the compressed air can be introduced into the introducing passage from the air passage formed between the circumferential wall of the combustion cylinder and the housing. Therefore, as compared with the prior art combustor including the rather long pre-mixing duct extending from the head portion of the combustor cylinder up to the air ports used for the supplemental burner provided to the circumferential wall of the combustor cylinder, the combustor of this invention can be provided in a more compact form. Further, since the compressed air can be deflected radially inward into the combustor cylinder due to the introducing passage, such deflected compressed air can generate considerably strong turbulence in the air flow, thus highly enhancing the effect of mixing the compressed air and fuel. As such, the pre-mixed gas that is quite uniform and thus exhibits substantially less unevenness of the fuel concentration can be obtained. Besides, since such uniform pre-mixed gas exhibiting less unevenness of the fuel concentration can be combusted in high-temperature combustion gas present on the downstream side relative to the main burner, the discharge amount of NOx can be significantly reduced. Moreover, since sufficient penetrating force for penetrating radially inward into the atmosphere in the combustor cylinder can be provided to the pre-mixed gas due to the introducing passage, backfire into the introducing passage and/or serious damage of the supplemental burner caused by such backfire can be successfully avoided. Additionally, since the pre-mixed gas can penetrate enough into the high-temperature combustion gas present around the center of the combustion chamber, significantly uniform temperature distribution can be formed around an outlet of the combustor.

In this invention, it is preferred that the supplemental burner further includes: an annular inlet port constituting an inlet of the introducing passage; and a plurality of guide pieces provided to the annular inlet port and configured to guide the compressed air toward a center of the inlet port.

With this configuration, the compressed air can be introduced toward the center of the inlet port. Therefore, a swirled component of the compressed air can be substantially reduced in the introducing passage, thereby increasing the penetrating force of the pre-mixed gas for penetrating into the atmosphere in the combustion chamber. Further, since the compressed air; after flowed through the guide pieces, can be deflected by 90° radially inward into the combustor cylinder, the considerably strong turbulence can be generated in the air flow, thereby to further enhance the mixing effect between the air and the fuel.

In this invention, it is preferred that the fuel nozzle includes a nozzle plate constituting a head of the introducing passage, the fuel injection holes being provided in the nozzle plate such that the fuel is supplied into the introducing passage through the fuel injection holes and a space between each adjacent pair of the guide pieces.

With this configuration, since the plurality of fuel injection holes are respectively arranged, corresponding to each space between the guide pieces, in the circumferential direction of the nozzle plate, the fuel can be injected from multiple points. Besides, the fuel can be supplied into the introducing passage while being divided along the circumferential direction by the respective guide pieces. Therefore, the pre-mixed gas that is more uniformly produced and thus exhibits further reduced unevenness of the fuel concentration can be obtained. Furthermore, with only the provision of the fuel injection holes respectively oriented and opened vertically to the nozzle plate, the fuel can be injected from such fuel injection holes, orthogonally to the compressed air flowed in the introducing passage. Thus, the fuel can be finely sectioned by shearing force exerted from the compressed air, thereby further enhancing the mixing effect between the compressed air and the fuel.

In this invention, it is preferred that the supplemental burner further includes a guide cylinder extending from the inlet port up to a downstream side relative to the guide pieces so as to constitute an outer wall forming an upstream part of the introducing passage.

With this configuration, since the guide cylinder extends up to the downstream side relative to the guide pieces, a relatively long pre-mixing length can be provided for pre-mixing the compressed air with the fuel on the downstream side relative to the guide pieces, i.e., on the downstream side relative to the fuel injection holes, by this guide cylinder and an introducing cylinder located on the downstream side relative to the guide cylinder. This can promote the effect of pre-mixing the compressed air with the fuel, thereby obtaining further uniform pre-mixed gas exhibiting substantially less unevenness of the fuel concentration.

In this invention, it is preferred that the supplemental burner further includes an introducing cylinder attached to the combustor cylinder so as to constitute a downstream part of the introducing passage.

With this configuration, since a proper existing combustion cylinder including the introducing cylinder can be directly used, the production cost can be substantially saved.

In the case in which the above introducing cylinder is employed, it is preferred that a gap is provided between the guide cylinder and the introducing cylinder located on a downstream side relative to the guide cylinder.

Such provision of the gap between the guide cylinder and the introducing cylinder can successfully control or cancel undue change or shift in position and attitude of these two cylinders, even when the precision in the size and/or attachment position of the two cylinders is not so high. Therefore, the flexibility in production and assembly of the combustor can be significantly improved. Further, with careful control of the size of this gap, in view of some negative impact, such as unduly strong turbulence or the like, that would be caused by the gap and exerted on the pre-mixed gas flowed in the two cylinders, the generation of NOx can be positively suppressed.

In this invention, it is preferred that the introducing passage has an inlet passage area which is greater than an outlet passage area.

With this configuration, the introducing passage can be provided in a substantially tapered form so that the area thereof is decreasing from the inlet thereof to the outlet thereof. Therefore, the flow velocity of the compressed air introduced into the inlet port can be increased during the travel up to the outlet port. Thus, the penetrating force of the compressed air for penetrating radially inward into the atmosphere in the combustor cylinder can be substantially increased.

In this invention, it is preferred that the supplemental burner further includes: an annular inlet port constituting an inlet of the introducing passage; and an inflow adjuster configured to cover an outer circumference of the annular inlet port with a space therebetween.

In this configuration, the inflow adjuster can positively suppress unwanted variation, in the circumferential direction, of the dynamic pressure of the compressed air flowed into the inlet port. As such, the amount of the compressed air flowed into the introducing passage from the inlet port can be controlled to be more uniform in the circumferential direction. Therefore, the pre-mixed gas that can exhibit significantly less unevenness of the fuel concentration can be obtained.

Namely, according to the present invention, the supplemental burner is provided to the combustion cylinder on the downstream side relative to the main burner located at the head portion of the combustion cylinder, thereby to introduce part of the compressed air into the introducing passage of the supplemental burner from the air passage formed between the circumferential wall of the combustion cylinder and the housing. Therefore, unlike the structure of the conventional combustor including the rather long pre-mixing duct extending from the head portion of the combustor cylinder up to the air ports used for the supplemental burner provided to the circumferential wall of the combustor cylinder, the combustor of this invention can be provided in the significantly compact form. Further, since adequately strong turbulence in the air flow can be generated by the deflection of the compressed air in the introducing passage, the mixing effect between the compressed air and the fuel can be highly enhanced. This can provide the pre-mixed gas that is quite uniform and thus exhibits significantly less unevenness of the fuel concentration. Besides, since such uniform pre-mixed gas exhibiting less unevenness of the fuel concentration can be combusted in the high-temperature combustion gas present on the downstream side relative to the main burner, the discharge amount of NOx can be significantly reduced. Moreover, since sufficient penetrating force for penetrating radially inward into the atmosphere in the combustor cylinder can be provided to the pre-mixed gas due to the introducing passage, the backfire into the introducing passage and/or serious damage of the supplemental burner caused by such backfire can be successfully avoided or eliminated. In addition, since the pre-mixed gas can penetrate enough into the high-temperature combustion gas present around the center of the combustion chamber, significantly uniform temperature distribution can be formed at the outlet of the combustor.

BRIEF DESCRIPTION OF THE DRAWINGS

The present invention will be understood more apparently from the following descriptions on several embodiments, with reference to the attached drawings. However, such descriptions and drawings for these embodiments are respectively provided herein by way of example only, and not intended in any way to limit the scope of this invention. Namely, the scope of this invention is limited only by the appended claims. It is noted that like reference numerals or characters given in the drawings will designate like or equivalent parts or elements, respectively.

FIG. 3A is an enlarged longitudinal section of the supplemental burner, and FIG. 3B is a section taken along line IIIB-IIIB in FIG. 3A.

FIG. 6A shows the case of the first embodiment, and FIG. 6B shows the case of the comparative example.

FIG. 7A is a longitudinal section of the supplemental burner, and FIG. 7B is a section taken along line VIIB-VIIB in FIG. 7A.

FIG. 8A is a longitudinal section of the supplemental burner, FIG. 8B shows a section taken along line VIIIB-VIIIB in FIG. 8A, FIG. 8C is an enlarged side view of a key portion shown in FIG. 8A, and FIG. 8D is a section taken along line VIIID-VIIID in FIG. 8C.

DESCRIPTION EMBODIMENTS

Figure 1:
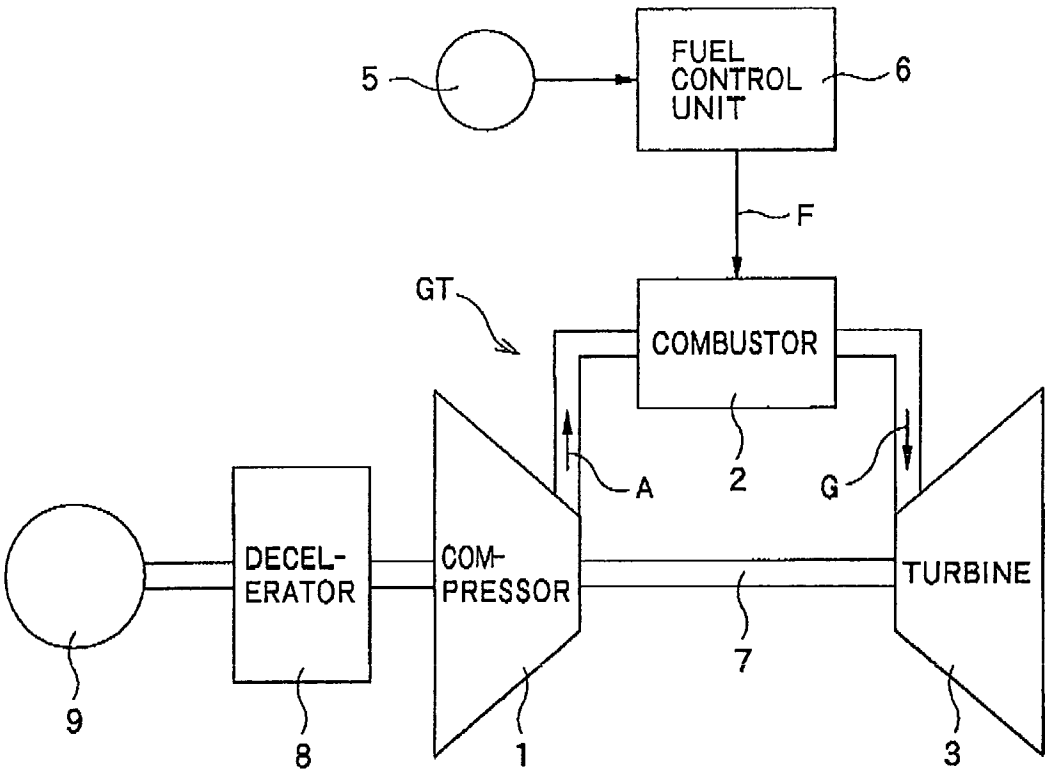
FIG. 1 is a schematic diagram for illustrating construction of a gas turbine electric generation system, to which the gas turbine combustor according to a first embodiment of the present invention is applied.

Hereinafter, several preferred embodiments will be detailed with reference to the drawings. In FIG. 1, the gas turbine GT includes the compressor 1, combustor 2 and turbine 3, as main components thereof, wherein the combustor 2 includes a fuel supply unit 5 and a fuel control unit 6. In the combustor 2, the fuel F supplied from the fuel supply unit 5 via the fuel control unit 6 can be combusted with the compressed air A supplied from the compressor 1. Thus, high-temperature and high-pressure combustion gas G generated by such combustion can be supplied to the turbine 3. As a result, the turbine 3 can be driven. Then, the compressor 1 is driven by the turbine 3 via a rotary shaft 7. Further, an electric generator 9 is driven by the turbine 3 via a decelerator 8.

Figure 2:
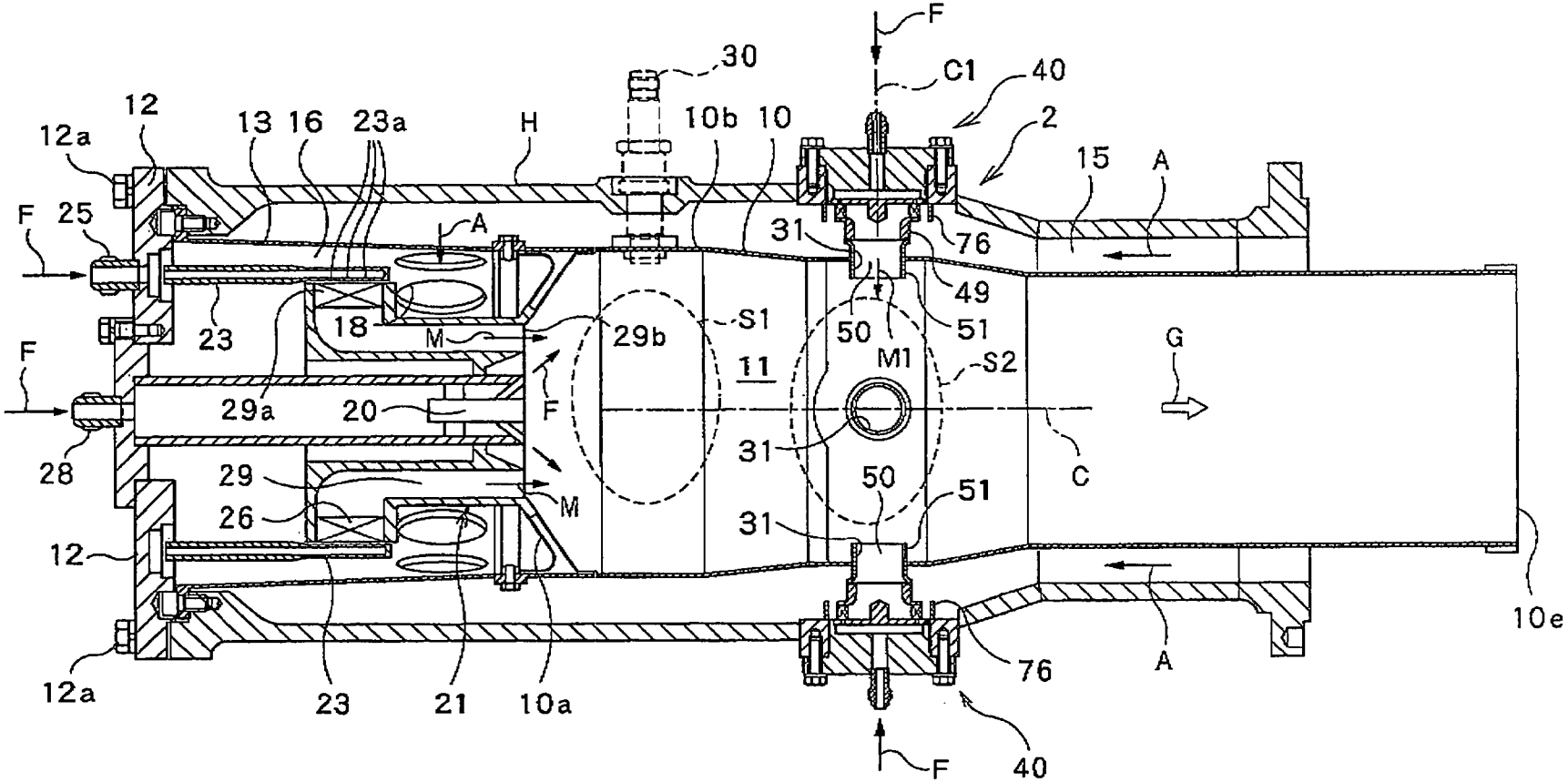
FIG. 2 is a longitudinal section of the gas turbine combustor according to the first embodiment.

As shown in the longitudinal section of FIG. 2, the combustor 2 is of a counter-flow can type configured for allowing the compressed air A introduced therein to be flowed in a direction reverse to the direction in which the combustion gas G is flowed in the combustor 2. This combustor 2 has the cylindrical housing H, in which the combustor cylinder 10 having a substantially cylindrical shape is housed. Further, the combustion chamber 11 is provided in the combustor cylinder 10. In addition, an end cover 12 is fixed in position at an upstream end (i.e., a left end in FIG. 2) or head of the housing H by means of bolts 12*a*.

Further, at the head of the housing H, a proximal end of a support cylinder 13 extending in the housing H is connected. Meanwhile, a distal end (i.e., a right end in FIG. 2) of the support cylinder 13 is fixed to the head 10*a* of the combustor cylinder 10. Namely, this combustor cylinder 10 is supported by the housing H via the support cylinder 13. Between the housing H surrounding the combustor cylinder 10 and the circumferential wall 10*b* of the combustor cylinder 10, the annular air passage 15 for introducing the compressed air A from the compressor 1 toward the head 10*a* (i.e., the upstream end) of the combustor cylinder 10 is provided. Further, an air introducing chamber 16 is provided inside the support cylinder 13, and a plurality of air introducing apertures 18 for introducing the compressed air A into the air introducing chamber 16 are formed in the support cylinder 13.

In a central portion of the head 10*a* of the combustor cylinder 10, a single diffusion-combustion type pilot burner 20 is provided for directly injecting the fuel F into the combustion chamber 11. Further, the single pre-mixing type main burner 21 is provided to surround the outer circumference of the pilot burner 20. This main burner 21 can serve to inject the pre-mixed gas M produced by mixing the fuel F with the compressed air A into the combustion chamber 11 from a pre-mixing passage 29.

In the main burner 21, the pre-mixing passage 29 having an L-shaped longitudinal section is opened radially outward via an annular air intake port 29*a*. Further, a plurality of main fuel nozzles 23 are arranged with an equal interval along the outer circumference of the main burner 21 radially outside relative to the opened annular air intake port 29*a*. In this case, a plurality of main fuel ejection holes 23*a* are respectively provided to the main fuel nozzles 23 in positions respectively opposed to the air intake port 29*a*. The proximal end of each main nozzle 23 is connected with a main fuel introducing port 25 provided to the end cover 12. Further, a swirler 26 is provided to the air intake port 29*a*. Thus, the fuel F supplied from the main fuel introducing port 25 can be swirled by the swirler 26 together with the compressed air A introduced from the air intake port 29*a*. In this manner, such swirled fuel and compressed air can be pre-mixed in the pre-mixing passage 29, and then injected, as the pre-mixed gas M, into the combustion chamber 11 from a pre-mixing injection port 29*b*.

The fuel F can be supplied to a pilot fuel introducing port 28 and the main fuel introducing port 25 from the fuel supply unit 5 shown in FIG. 1 via the fuel control unit 6.

An ignition plug 30 is provided to an upstream portion of the circumferential wall 10*b* of the combustor cylinder 10 with a distal end of the plug 30 facing the interior of the combustor chamber 11. This ignition plug 30 is fixed in position to the housing H while extending through the housing H. When the engine is started, the fuel F is injected into the combustion chamber 11 from the pilot burner 20, and then the diffusion combustion is performed by ignition due to the ignition plug 30. Then, upon a normal operation, the pre-mixed gas M injected into the combustion chamber 11 from the main burner 21 is combusted so as to form a first combustion region S1 in an upstream portion of the combustor cylinder 10 on the downstream side relative to the main burner 21. In this case, the plurality of, for example, four, air ports 31 are provided circumferentially with an equal interval on the downstream side relative to the first combustion region S1 in the combustor cylinder 10. Further, the pre-mixing type supplemental burners 40 are provided in positions respectively opposite to the air ports 31 in the housing H with each distal end thereof facing the interior of the combustion chamber 11 through each corresponding air port 31. In this manner, each supplemental burner 40 is arranged to extend through the circumferential wall 10*b* of the combustor cylinder 10 in the downstream portion of the combustor cylinder 10 relative to the main burner 21. In this case, each supplemental burner 40 can serve to inject the pre-mixed gas M1 used for the supplemental burner into the combustor cylinder 10 so as to form a second combustion region S2 on the downstream side relative to the first combustion region S1 in the combustion chamber 11.

Figure 3A:
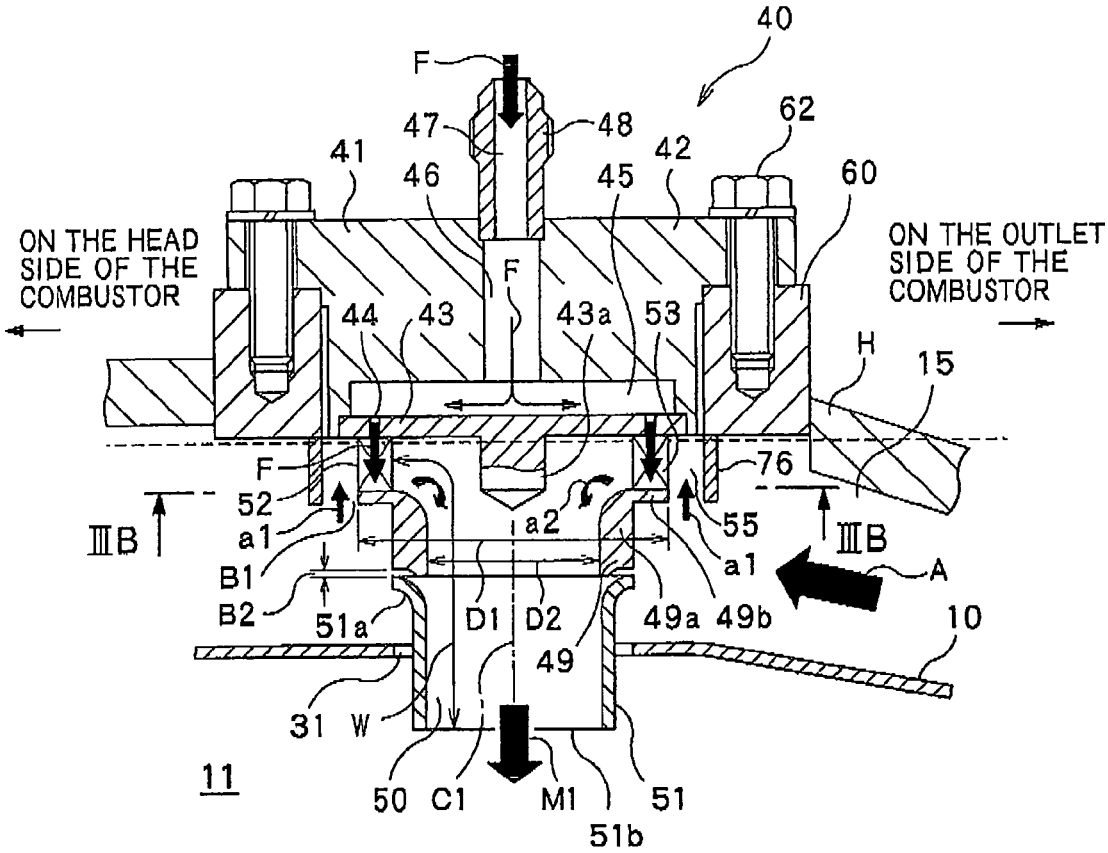
FIGS. 3A and 3B show the supplemental burner used for the gas turbine combustor according to the first embodiment.
Figure 3B:
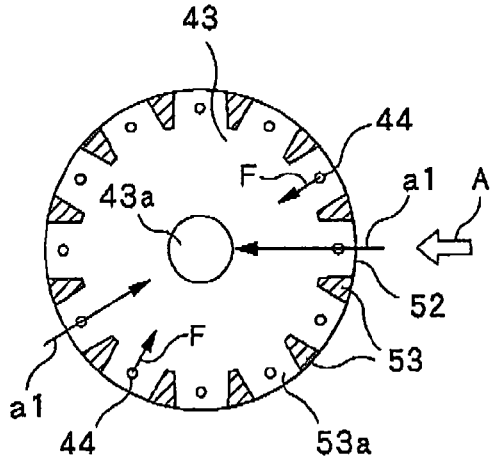

FIGS. 3A and 3B illustrate details of one supplemental burner 40. As shown in FIG. 3A, the supplemental burner 40 has a straight burner axis C1 orthogonal to an axis C (see FIG. 2) of the combustor cylinder 10. Further, this supplemental burner 40 includes the introducing passage 50 configured for deflecting and introducing a part of the compressed air A flowed toward the head 10*a* of the combustor cylinder 10 from the annular air passage 15 radially inward toward the interior of the combustion cylinder 10, and the fuel nozzle 41 adapted for supplying the fuel F into the introducing passage 50 so as to mix the fuel F with the deflected part of the compressed air A in the introducing passage 50, thus producing the pre-mixed gas M1.

The fuel nozzle 41 includes a cylindrical nozzle body 42 having a flange portion attached to a mount 60 provided to the housing H by means of fastening members 62, such as bolts or the like, and the disk-like nozzle plate 43 fixed to the nozzle body 42 with a fuel reservoir 45 provided between the fuel nozzle 41 and the nozzle plate 43. The nozzle body 42 and nozzle plate 43 are respectively arranged, concentrically with the burner axis C1. Further, this supplemental burner 40 includes the guide cylinder 49 constituting the upstream part of the introducing passage 50 together with the nozzle plate 43, the introducing cylinder 51 attached to the combustor cylinder 10 and constituting the downstream part of the introducing passage 50, and the inflow adjuster 76 provided to cover the outer circumference of the inlet port 52 of the guide cylinder 49 with the space B1 provided therebetween.

The inlet port 52 of the guide cylinder 49 has an annular shape concentric with the burner axis C1, and the inflow adjuster 76 has a cylindrical shape also concentric with the burner axis C1. The inflow adjuster 76 is fixed in position to a bottom face of the mount 60. In this case, the axial position of a top end of the inflow adjuster 76 is the same as the level of a top end of the inlet port 52, while the axial position of a bottom end of the inflow adjuster 76 is set below a bottom edge of the inlet port 52, i.e. more radially inward toward the combustor cylinder 10, as compared with the bottom end of the inlet port 52. In this manner, the inflow adjuster 76 can completely cover the inlet port 52 radially from the outside with the space B1 provided therebetween. In other words, an inlet passage 55 located on the upstream side of the introducing passage 50 is formed of this space B1. With the provision of this inlet passage 55, part of the compressed air A once introduced radially outward relative to the combustion cylinder 10 can be in turn introduced into the introducing passage 50. In this configuration, the inflow adjuster 76, guide cylinder 49 and introducing cylinder 51 are respectively arranged, concentrically with the burner axis C1. Additionally, an axial gap B2 is provided between the guide cylinder 49 and the introducing cylinder 51. An inlet 51*a* of the introducing cylinder 51 has a bellmouth-like shape that is curved or opened in the diametrical direction thereof.

The inlet port 52 constituting the inlet of the introducing passage 50 is opened radially outward relative to the burner 40, i.e., orthogonally outward relative to the burner axis C1 of the burner 40. The guide cylinder 49 includes a cylindrical trunk portion 49*a* extending concentrically with the burner axis C1, and a mouth portion 49*b* which is opened radially outward as one moves toward the upstream side thereof (or upward). Thus, the diameter D1 of the inlet port 52 located at the distal edge of the mouth portion 49*b* is greater than the inner diameter D2 of the trunk portion of the guide cylinder 49 located on the downstream side relative to the inlet port 52. In the inlet port 52, the plurality of guide pieces 53 are provided for respectively guiding the compressed air A toward the center of the inlet port 52. The guide cylinder 49 extends long, by a certain distance, from the inlet port 52 to a point on the downstream side relative to the respective guide pieces 53. The nozzle body 42 and nozzle plate 43, the nozzle plate 43 and guide pieces 53, and the guide pieces 53 and guide cylinder 49 are respectively fixed to one another, such as by welding or the like. It is noted that the introducing cylinder 51 may be a proper existing one that can be directly used in the conventional cylinder 10.

The plurality of fuel injection holes 44 are provided through the periphery of the nozzle plate 43, while being respectively communicated with the fuel reservoir 45 and opened radially inward toward the combustion cylinder 10. Further, such fuel injection holes 44 are respectively arranged concentrically with the nozzle plate 43. Additionally, a fuel introducing passage 46 for introducing the fuel F into the fuel reservoir 45 is formed in the nozzle body 42. Further, a nipple 48 constituting a fuel introducing port 47 for introducing the fuel into the fuel introducing passage is attached to the nozzle body 42. With this configuration, the fuel F can be introduced into the fuel reservoir 45 through the fuel introducing port 47 and fuel introducing passage 46, and then supplied into the introducing passage 50 via the fuel injection holes 44. Furthermore, a central projection 43*a* having a distal end of an inverted-cone shape is provided at a central portion of the nozzle plate 43. This central projection 43*a* extends downward slightly longer than at least the height (or vertical length) of each guide piece 53.

As shown in FIG. 3B, the guide pieces 53 are provided in a plural number (e.g., twelve (12)), concentrically with the nozzle plate 43 with an equal interval along the circumference of the nozzle plate 43. Meanwhile, the fuel injection holes 44 respectively formed in the nozzle plate 43 covering a top portion of the guide pieces 53 are arranged, while one or more of the hole 44 (e.g., respective one hole 44 in this embodiment) are provided for each space between the respective adjacent guide pieces 53. When the compressed air A is flowed from the air passage 15 into the inlet port 52 constituting the inlet of the introducing passage 50, this air A is first flowed into the inlet port 52 through a plurality of divided ports 53*a* provided between the respective adjacent guide pieces 53, and then introduced toward the center of the inlet port 52. Thereafter, each air flow a1 flowed into the inlet port 52 through each divided port 53*a* is deflected downward, by 90° due to an effect of the central projection 43*a*. Further, with the provision of such a central projection 43*a*, mutual collision of the air flow a1 and the resultant lowering of the flow velocity of the air flow a1 that would be otherwise caused by such collision can be effectively avoided. At this time, the air flow a1 can always strike the central projection 43*a*, regardless of which divided port 53*a* the air flow a1 flowed through. Then, such an air flow a1 will be compulsorily deflected radially inward toward the combustor cylinder 10 along the distal inverted-cone shape of the central projection 43*a*. Thereafter, the deflected air flow a1 can be flowed into the introducing cylinder 51 through the guide cylinder 49, and finally introduced into the combustor cylinder 10 from the outlet port 51*b* of the introducing cylinder 51 that is the outlet of the introducing passage 50.

Figure 4:
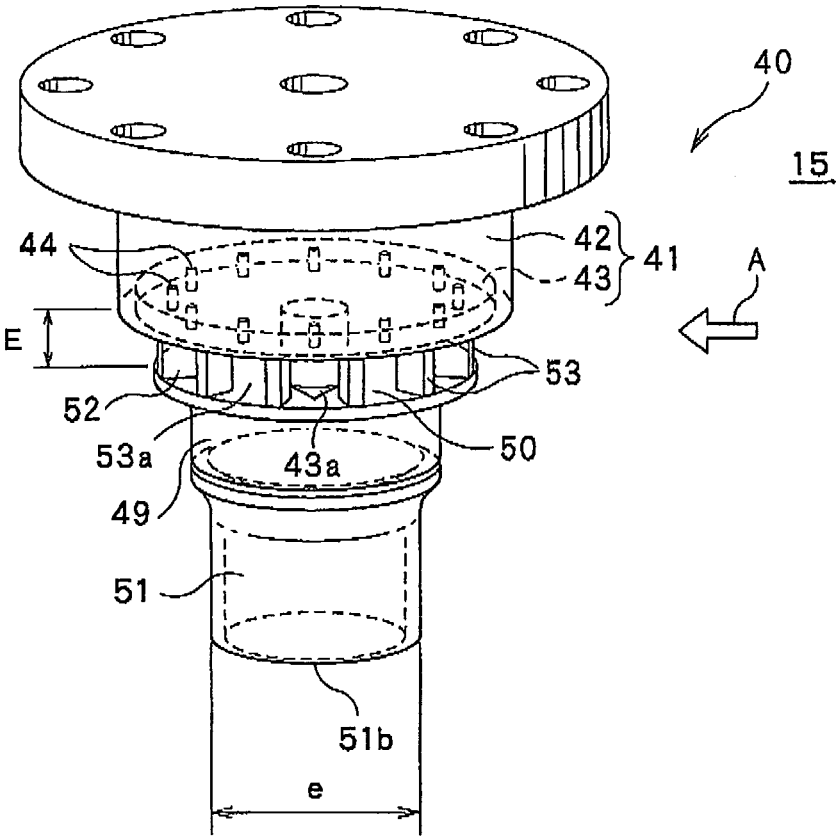
FIG. 4 is a perspective view showing the supplemental burner.

As apparently shown in the perspective view of the supplemental burner 40 in FIG. 4, each divided port 53*a* is opened along the outer circumference of the supplemental burner 40. Namely, the compressed air A can be introduced into the introducing passage 50 through only such divided ports 53*a*. Meanwhile, as shown in FIG. 3A, the fuel F is injected from each fuel injection hole 44 of the nozzle plate 43 toward each divided port 53*a* (see FIG. 3B) between each adjacent pair of the guide pieces 53 located downward relative to the fuel injection hole 44. At this time, the fuel F is injected from each fuel injection hole 44 orthogonally to the compressed air A. Therefore, the fuel F can be finely sectioned by the shearing force exerted from the compressed air A, thus enhancing the mixing effect between the compressed air A and the fuel F.

The passage area E of the inlet port 52 shown in FIG. 4, i.e., the total opening area of the divided ports 53*a*, is set to be greater than the passage area e of the outlet port 51*b* of the introducing cylinder 51. With such setting of these areas, the introducing passage 50, into which the compressed air A is introduced, can be provided to be tapered as one moves from the inlet port 52 that is the inlet of this passage 50 to the outlet port 51*b* of the introducing cylinder 51 that is the outlet of the passage 50. Therefore, the flow velocity of the compressed air A introduced into the inlet port 52 from the air passage 15 can be increased at the outlet port 51*b* of the introducing cylinder 51. Namely, the penetrating force of the compressed air A for penetrating radially inward into the atmosphere in the combustor cylinder 10 shown in FIG. 3A can be substantially increased.

In this case, the guide pieces 53, guide cylinder 49 and introducing cylinder 51 are located between the inlet port 52 and the outlet port of the introducing cylinder 51 and constitute together the introducing passage 50, where the air A and fuel F can be mixed. Namely, a pre-mixing length W, over which the compressed air A and fuel F can be pre-mixed, is set to be substantially longer than the pre-mixing length W1 of the supplemental burner related to one comparative example that will be described later and shown in FIGS. 5A and 5B. With the setting of such a relatively long pre-mixing length W, the time for pre-mixing the compressed air A with the fuel F can also be substantially elongated, thereby well mixing the compressed air with A the fuel F, thus producing significantly uniform pre-mixed gas M1 exhibiting less unevenness of the concentration of the fuel F.

Now, referring to FIG. 2, the operation of the gas turbine combustor constructed as described above will be discussed. In the case in which a diffusion operation (or non-low-NOx operation) is performed, upon and/or after the start of the combustor system 2, the pilot burner 20 is operated to inject the fuel F introduced from the fuel introducing port 28 into the combustion chamber 11, thereby to perform the diffusion combustion. Meanwhile, in the case of a normal operation (or low-NOx operation), the main burner 21 is operated to inject the pre-mixed gas M produced in the main burner 21 into the combustion chamber, thereby to perform lean combustion in the first combustion region S1. Thus, the combustion temperature in the combustion chamber 11 can be lowered, thereby suppressing the generation of NOx. In this state, the pre-mixed gas M1 injected from the supplemental burner 40 located on the downstream side is introduced and combusted in each second combustion region 52, where the temperature is highly elevated due to the presence of the first combustion region S1. Thus, the generation of NOx in the respective second combustion regions S2 can also be suppressed, thereby substantially reducing the discharge amount of NOx.

In the supplemental burner 40, part of the compressed air A flowed in the air passage 15 toward the head of the combustion cylinder 10 is flowed into the inlet passage 55 located between the inflow adjuster 76 and the inlet port 52, as designated by an arrow a1 depicted in FIG. 3A, and then advanced into each space between the respective guide pieces 53 located at the inlet port 52 that is the inlet of the introducing passage 50. Thereafter, the compressed air a1 strikes the central projection 43*a*, and thus deflected by 90° as designated by an arrow a2. As a result, the compressed air a1 will be introduced radially inward into the combustion cylinder 10. In this manner, the compressed air a1 flowed into the inlet passage 55 between the inflow adjuster 76 and the guide cylinder 49 is once flowed, radially outward relative to the combustion cylinder 10, through the inlet passage 55, then deflected by 90°, and finally flowed into the introducing passage 50 from the inlet port 52.

In general, the compressed air A tends to be flowed into the inlet port 52 in a greater amount from a part of the inlet port 52 facing the upstream side (i.e., a right-side part of the inlet port 52, in FIG. 3A) than from a part of the inlet port 52 facing the downstream side because the dynamic pressure of the compressed air A is higher at the upstream side than at the downstream side. In other words, the compressed air A tends to be flowed into the inlet port 52 in a relatively reduced amount from an opposite part of the inlet port facing the downstream side (i.e., a left-side part of the inlet port 52, in FIG. 3A) because of the relatively lowered dynamic pressure of the compressed air A at the downstream side. However, in this embodiment, since the inflow adjuster 76 can adequately control the dynamic pressure of the compressed air A, the dynamic pressure of the compressed air a1 flowed into the inlet passage 55 provided between the guide cylinder 49 and the inflow adjuster 76, especially a part of the inflow adjuster 76 (i.e., a right-side part) facing the upstream side relative to the compressed air A, can be effectively reduced. As a result, variation. In the circumferential direction of the dynamic pressure of the compressed air a1 flowed into the inlet port 52 can be successfully suppressed, thereby effectively controlling the amount of the compressed air flowed into the introducing passage 50 from the inlet port 52 to be circumferentially uniform. Thus, the pre-mixed gas M1 exhibiting less unevenness of the fuel concentration can be produced.

Moreover, since the compressed air a1, after flowed through the guide pieces 53, is deflected by 90° radially inward toward the combustion cylinder 10 in the guide cylinder 49 constituting the upstream part of the introducing passage 50, relatively strong turbulence can be generated in the air flow by such deflection of the compressed air a1. Meanwhile, since the fuel F is injected into the plurality of circumferentially divided regions provided between the respective guide pieces 53 from the fuel injection holes 44, the unevenness of the fuel concentration in the circumferential direction can be well controlled. In addition, since the fuel F is injected in the direction orthogonal to the flow direction of the compressed air A from the fuel injection holes 44 respectively opened radially inward toward the combustion cylinder 10 shown in FIG. 3A, the fuel F can be finely sectioned by the shearing force exerted from the compressed air A, thereby substantially enhancing the mixing effect between the compressed air A and the fuel F. Thereafter, as described above, the mixed gas can be deflected by 90°. During this deflection, the mixed gas will be well stirred by the strong turbulence of the compressed air a1, as such the mixing effect of the compressed air A and fuel F can be further enhanced.

Once the compressed air A and fuel F are well mixed together after flowed through the guide cylinder 49 extending up to the downstream side relative to the guide pieces 53 as well as through the introducing cylinder 51 located downstream relative to the guide cylinder 49 shown in FIG. 3A, the pre-mixed gas M1 is produced and flowed into the combustion chamber 11 located inside the combustion cylinder 10. Accordingly, in a plane crossing the outlet port 51*b* of the introducing cylinder 51, the pre-mixed gas M1 that is quite uniform and exhibits less unevenness of the concentration of the fuel F can be obtained. Namely, because such uniform pre-mixed gas exhibiting so less unevenness of the fuel concentration can be combusted in each second combustion region S2, i.e., under the atmosphere of high temperature combustion gas present on the downstream side relative to the first combustion region S1, the discharge amount of NOx can be significantly reduced. Further, as described above, the pre-mixed gas M1 can be provided with adequate penetrating force for penetrating radially inward into the atmosphere in the combustor cylinder 10 due to the introducing passage 50. Such penetrating force of the pre-mixed gas M1 can successfully avoid occurrence of serious damage of the supplemental burner 40 caused by the backfire into the introducing passage 50, while allowing the pre-mixed gas M1 to penetrate well into the atmosphere of high temperature combustion gas present around the central portion of the combustion chamber 10. Therefore, such pre-mixed gas M1 can be well combusted in the high temperature combustion gas.

Figure 5A:
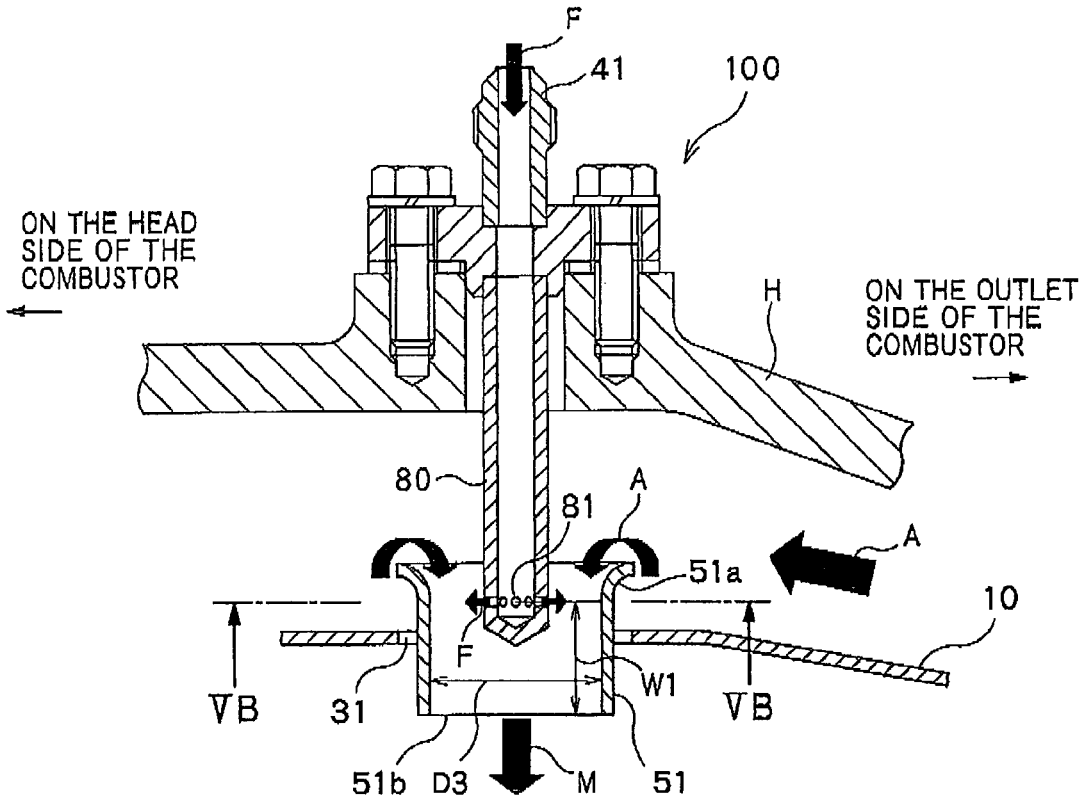
FIG. 5A is an enlarged longitudinal section of the supplemental burner of a comparative example.

In this embodiment, the pre-mixing length W in the introducing passage 50 corresponds to the length from the respective fuel injection holes 44 to the outlet port 51*b* of the introducing cylinder 51 across the guide cylinder 49. Meanwhile, in the case of the supplemental burner 100 of the comparative example shown in FIGS. 5A and 5B, unlike the first embodiment of the present invention described above, the guide cylinder is not provided. Namely, in this comparative example, as shown in FIG. 5A, the fuel nozzle is constructed by providing the fuel injection holes 81 at a distal end of a straight fuel pipe 80, while such fuel injection holes 81 are positioned inside the introducing cylinder 51. Therefore, the pre-mixing length W1 of this comparative example corresponds to the distance from the respective fuel injection holes 81 of the fuel pipe 80 to the outlet port 51*b* of the introducing cylinder 51, thus being rather shortened, compared with the pre-mixing length W of the first embodiment of the present invention. Besides, this pre-mixing length W1 is shorter than the inner diameter D3 of the introducing cylinder 51. Accordingly, the longer pre-mixing length W, as shown in FIG. 3A, of the first embodiment can take the longer time for pre-mixing the fuel F with the compressed air A, thereby producing the pre-mixed gas M1 that is quite uniform and exhibits less unevenness of the concentration of the fuel F.

Figure 5B:
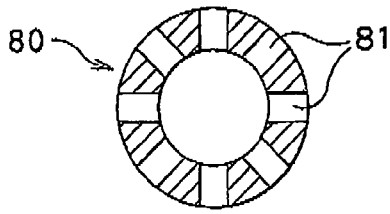
FIG. 5B is a section taken along line VB-VB in FIG. 5A.

Further, as is seen from FIG. 5B showing the above comparative example, the diameter of the section of the fuel pipe 80 that can also be used as the fuel nozzle is relatively small, and provided with a relatively small number (e.g., eight (8)) of fuel injection holes 81. Therefore, the fuel cannot be injected from adequately multiple points. Meanwhile, in the case of the first embodiment, as shown in FIG. 3A, the fuel injection holes 44 are provided in the plural number (e.g., twelve (12)) in the vicinity of the inlet port 52 of the guide cylinder 49, i.e., in the periphery of the nozzle plate 43, having the diameter substantially greater than the diameter of the introducing cylinder 51. Therefore, in this embodiment, the fuel can be injected from sufficiently multiple points. This can also suppress the unevenness of the concentration of the fuel F in the pre-mixed gas M.

Since the introducing cylinder 51 may be the existing one that can be directly used in the conventional cylinder 10, the production cost can be saved. Further, since the supplemental burner 40 includes the annular inlet port 52 provided as the inlet of the introducing passage 50 and the plurality of guide pieces 53, each provided to the inlet port 52 and adapted for guiding the compressed air A toward the center of the inlet port 52, the compressed air A can be smoothly introduced toward the center of the inlet port 52, thereby substantially reducing a swirled flow of the compressed air A in the introducing passage 50. Thus, the penetrating force of the compressed air A into the atmosphere in the combustor cylinder 10 can be kept strong so much. Therefore, the pre-mixing effect of the compressed air A and fuel F can be further enhanced, as well as the backfire can be successfully avoided. Accordingly, the occurrence of damage of the supplemental burner 40 caused by such a backfire can also be avoided.

In addition, the provision of the gap B2, between the guide cylinder 49 and the introducing cylinder 51 located on the downstream side relative to the guide cylinder 49, can successfully avoid or control undue change and/or shift in position and attitude of the two cylinders 49, 51, even when the precision in the size and/or attachment position of the guide cylinder 49 and introducing cylinder 51 is not so high. Therefore, the flexibility in production and assembly of the combustor can be significantly improved. Further, with careful control of the size of the gap B2, in view of some negative impact that might be exerted on the pre-mixed gas M flowed inside the two cylinders 49, 51, the generation of NOx can be positively suppressed.

Moreover, since the area E of the passage of the inlet port 52 is set to be greater than the area e of the passage of the outlet port 51*b* of the introducing cylinder 51, the introducing passage 50 for the compressed air A is substantially tapered as one moves from the inlet thereof (i.e., the inlet port 52) to the outlet thereof (i.e., the outlet port 51*b*). Therefore, the flow velocity of the compressed air A can be increased, during the travel through the introducing passage 50. Thus, the penetrating force of the compressed air A for penetrating radially inward into the atmosphere in the combustor cylinder 10 can be adequately increased.

Figure 6A:
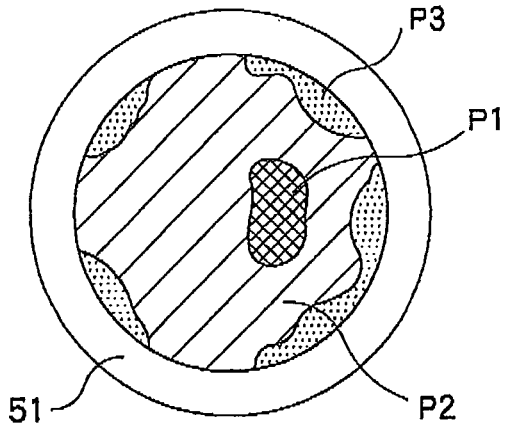
FIGS. 6A and 6B are diagrams showing distribution of concentration of the pre-mixed gas at an outlet of the supplemental burner.
Figure 6B:
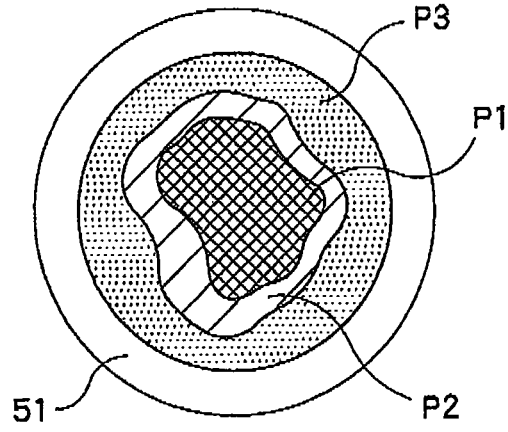

FIGS. 6A and 6B show the distribution of concentration of the pre-mixed gas M1 around the outlet port 51*b* of the introducing cylinder 51. FIG. 6A shows the case of the first embodiment, and FIG. 6B shows the case of the comparative example. In the comparative example shown in FIG. 6B, a first area P1 of a high concentration (the maximum concentration: 0.095) much greater than the concentration of a completely pre-mixed state occupies a considerably large part at a central portion of the outlet port 51*b*, while a second area P2 and a third area P3 are formed around the first area P1, with the concentration thereof being lowered in this order. In this case, the third area P3 of the lowest concentration is formed in a relatively wide part around the outer circumference of the outlet port 51*b*. Meanwhile, in the case of the first embodiment of the present invention shown in FIG. 6A, the first area P1 of the highest concentration (the maximum concentration; 0.043) is formed only in a narrow part at the central portion of the outlet port 51*b*, as well as the third area P3 of the lowest concentration is formed only slightly around the outer circumference of the outlet port 51*b*. The second area P2 of an intermediate concentration is widely spread in the outlet port 51 between the other two areas P1, P3, while exhibiting less unevenness of the fuel concentration on the whole. Accordingly, in the first embodiment, the maximum peak concentration of the fuel F can be reduced by substantially half as compared with the case of the comparative example. Further, the distribution of concentration of the fuel can be made substantially uniform, thereby generating the pre-mixed gas M exhibiting far less unevenness of the concentration of the fuel F.

As described above, according to the first embodiment of this invention, the pre-mixed gas M1 used for the supplemental burner can be produced in the introducing passage 50 by supplying the fuel F to part of the compressed air A introduced into the introducing passage 50 from the existing air passage 15. Therefore, the combustor can be constructed into a further compact form. Further, since the compressed air A can be deflected in the introducing passage 50 radially inward into the combustion cylinder 10, the penetrating force for penetrating enough radially inward into the atmosphere in the combustor cylinder 10 can be provided to the compressed air A. In addition, since the fuel F can be injected at the multiple points from the plurality of fuel injection holes 44, the compressed air A can be rapidly mixed with such fuel F in the introducing passage 50, thereby effectively producing the uniform pre-mixed gas M1 exhibiting less unevenness of the concentration of the fuel F. Further, because such uniform pre-mixed gas exhibiting less unevenness of the concentration of the fuel F can be combusted in the high temperature combustion gas in each second combustion region S2, the discharge amount of the NOx can be significantly reduced.

Figure 7A:
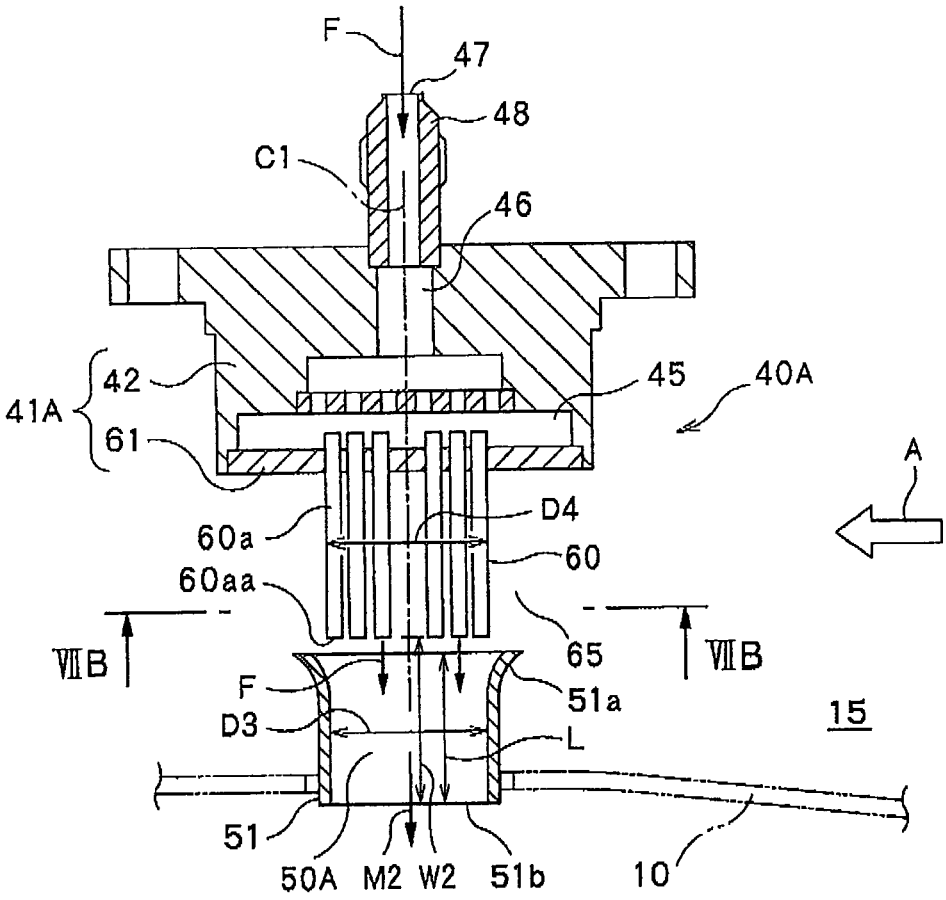
FIGS. 7A and 7B show the supplemental burner of the gas turbine combustor according to a second embodiment of the present invention.
Figure 7B:
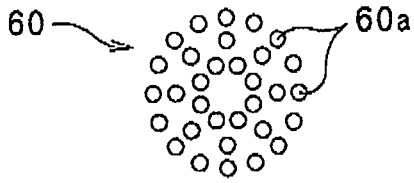

FIGS. 7A and 7B show the supplemental burner 40A used in the gas turbine combustor according to the second embodiment of this invention. In this second embodiment, like or equivalent parts described and shown in the first embodiment are respectively designated by like reference numerals and/or characters, and further descriptions on such parts will be omitted below. Namely, only the parts or components different from those described and shown in the first embodiment will be discussed below. In the second embodiment, as shown in FIG. 7A, a convergence pipe 60 is used in place of the guide cylinder 49 of the first embodiment. This convergence pipe 60 can serve as a fuel supply passage unit formed of a plurality of small fuel passages respectively bundled together. The introducing passage 50A is formed of the introducing cylinder 51. More specifically, the convergence pipe 60 is formed of a plurality of small pipes 60*a* respectively bundled together. Each small pipe 60*a* extends in the vertical direction, i.e., in the radial direction orthogonal to the axis C (see FIG. 2) of the combustor cylinder 10, with the fuel injection hole 60*aa* opened at a bottom end of each pipe 60*a* radially inward toward the combustor cylinder 10.

In the convergence pipe 60, as shown in FIG. 7B, for example, thirty two (32) small pipes 60*a* are bundled together with uniform distribution. The number of the small pipes 60*a* constituting the respective fuel small passages is preferably 10 or more that is greater than the number of the fuel injection holes provided in the aforementioned comparative example shown in FIG. 5, and is more preferably 16 or more, and more preferably 24 or more, for example, 32 or more. The outer diameter D4 of the convergence pipe 60 is substantially the same as the inner diameter D3 of the introducing cylinder 51. Thus, the fuel F can be injected over a relatively wide area into the introducing passage 50A from the convergence pipe 60. Therefore, the compressed air A can be mixed with the fuel F more uniformly. The small pipes 60*a* constituting together the convergence pipe 60 are respectively fixed to the nozzle plate 61 at each top end thereof, while each top end of the small pipes 60*a* extends through the nozzle plate 61. In this case, the fuel nozzle 41A includes the fuel reservoir 45 communicated with each top end of the small pipes 60*a*. A space between the nozzle plate 61 and the inlet 51*a* of the introducing cylinder 51 can serve as an air inlet 65 configured for taking therein the compressed air A from the air passage 15, i.e., the inlet of the introducing passage 50A. Meanwhile, each bottom end of the small pipes 60*a* faces the inlet 51*a* of the introducing cylinder 51, while being slightly spaced above, i.e., radially outward from the inlet 51*a*. This configuration can securely prevent the air inlet 65 from being closed by the convergence pipe 60, as such avoiding blockage against the inflow of the compressed air A that might be caused by the convergence pipe 60. Additionally, this configuration can ensure the adequate pre-mixing length W2 provided long from the bottom end of the convergence pipe 60 to the outlet port 51*b* of the introducing cylinder 51.

Figure 10A:
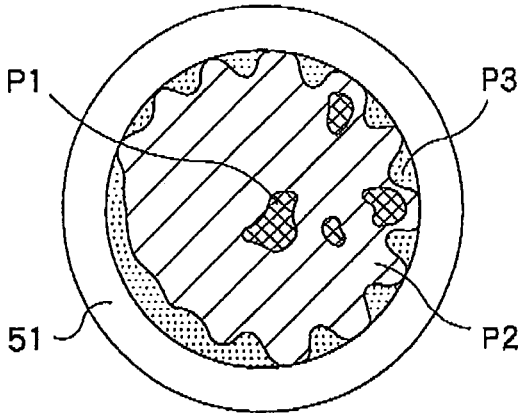
FIG. 10A is a diagram illustrating the distribution of concentration of the pre-mixed gas at the outlet of the supplemental burner related to the second embodiment.

In this second embodiment, the fuel F is first introduced into the respective small pipes 60*a* of the convergence pipe 60 from the fuel reservoir 45, and then injected into the introducing passage 50A from each fuel injection hole 60*aa* at the bottom ends of the small pipes 60*a* axially inward along the introducing cylinder 51, or radially inward toward the combustion cylinder 10. Thereafter, the fuel F and compressed air A are mixed together in the introducing cylinder 51, thereby producing the pre-mixed gas M2. In this case, the compressed air A is introduced via the inlet port 65, i.e., the inlet of the introducing passage 50A, while the fuel F is injected over a relatively wide area into the introducing passage 50A from the convergence pipe 60. Therefore, the fuel F and compressed air A can be mixed together more uniformly, resulting in the pre-mixed gas M2 exhibiting substantially less unevenness of the concentration of the fuel F. Moreover, since the adequate pre-mixing length W2 can be ensured, the pre-mixing effect of the fuel F and compressed air A can be further enhanced. Similarly, in this second embodiment, as shown in FIG. 10A illustrating the distribution of concentration in the pre-mixed gas M2 around the outlet port 51*b* of the introducing cylinder 51, i.e., the outlet of the supplemental burner 40B, the first area P1 exhibiting the maximum concentration (0.061) of the fuel F is quite small, and thus the distribution of concentration of the fuel F is made uniform, compared with the distribution of concentration of the comparative example shown in FIG. 6B. Therefore, this second embodiment can also provide the pre-mixed gas that can exhibit significantly less unevenness of the fuel concentration on the whole.

Figure 8A:
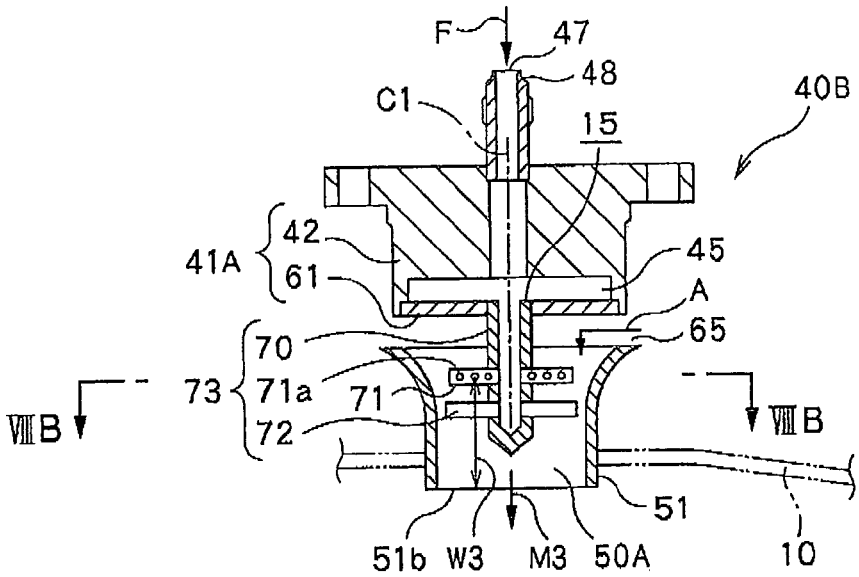
FIGS. 8A to 8D show the supplemental burner of the gas turbine combustor according to a third embodiment of the present invention.

FIGS. 8A to 8D show the supplemental burner 40B used in the gas turbine combustor according to the third embodiment. In this third embodiment, an injection unit 73 is provided in place of the guide cylinder 49 of the first embodiment. Specifically, as shown in FIG. 8A, this injection unit 73 includes a single fuel pipe 70 supported by the nozzle plate 67 and provided in communication with the fuel reservoir 45, fuel supply bars 71 respectively connected with the fuel pipe 70 while extending radially outward from the fuel pipe 70, and deflector bars 72 respectively connected with the fuel pipe 70 while extending below and in parallel with the respective fuel supply bars 71. It is noted that the fuel supply bars 71 and deflector bars 72 are respectively arranged in a plural number, for example, four, with an angularly equal interval in the circumferential direction about the fuel pipe 70.

Figure 8B:
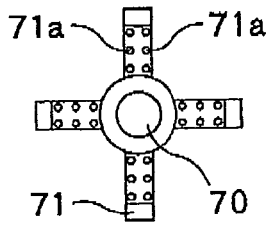
Figure 9:
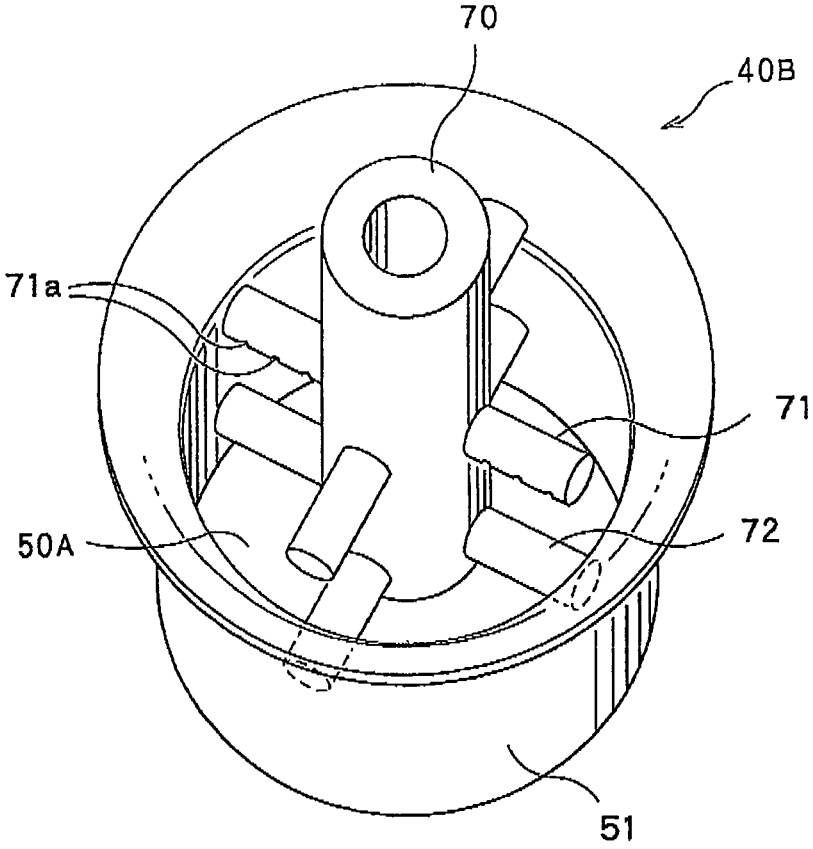
FIG. 9 is a perspective view of the supplemental burner related to the third embodiment.

Each fuel supply bar 71 includes a plurality of fuel injection holes 71*a* respectively arranged in the radial direction relative to the fuel pipe 70, and is located at an inner upstream portion of the introducing cylinder 51. In each fuel supply bar 71, as shown in FIG. 8B, the fuel injection holes 71*a* are arranged in two rows to be respectively opened in the circumferential direction, wherein the two rows respectively extend along the fuel supply bar 71 in parallel with each other with three fuel injection holes 71*a* arranged in each row. Thus, the fuel F can be injected from each fuel injection hole 71*a* in a direction substantially orthogonal to the compressed air A flowed through the introducing passage 50A in the introducing cylinder 51. Further, as shown in FIG. 8B as well as in FIG. 9 that is the perspective view of FIG. 8B, the fuel supply bars 71 and deflector bars 72 respectively form a cross shape on the whole, when seen in the axial direction of the fuel pipe 70, i.e., in the direction along the axis C1 of the supplemental burner 40B. Additionally, these bars 71, 72 are respectively arranged in the same angular position about the fuel pipe 70, such that these bars 71, 72 can be completely overlapped with each other, when seen in the axial direction. In this embodiment, a total of 1.5 twenty four (24) fuel injection holes 71*a* are employed. Preferably, the number of the fuel injection holes 71*a* is 12 or more, more preferably 16 or more, for example, 24 or more. Again, this embodiment can also ensure the adequate pre-mixing length W3, as defined by the length from the fuel injection holes 71*a* to the outlet port 51*b* of the introducing cylinder 51.

Figure 8C:
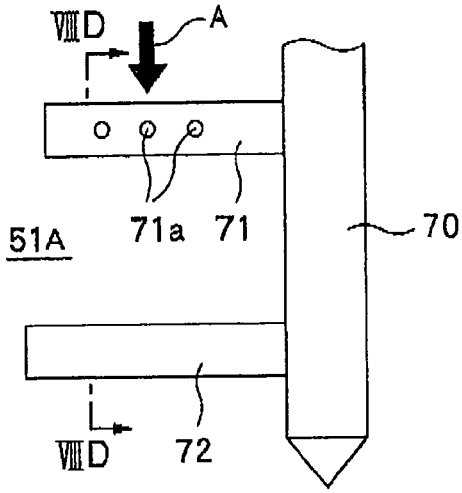
Figure 8D:
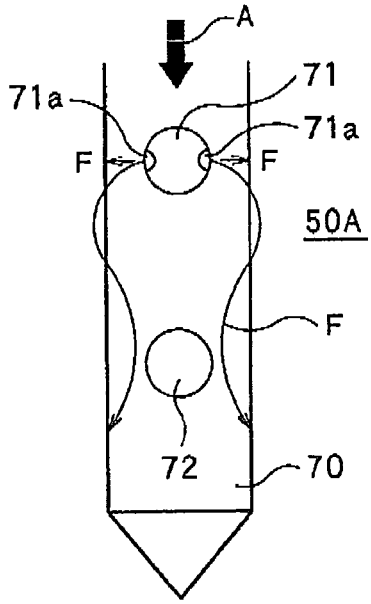
Figure 10B:
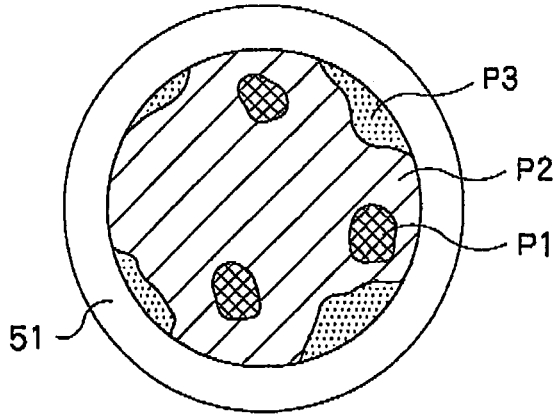
FIG. 10B is a diagram illustrating the distribution of concentration of the pre-mixed gas at the outlet of the supplemental burner related to the third embodiment.

In this third embodiment, for example, as shown in FIG. 8C, when the fuel F is injected into the introducing passage 50A of the introducing cylinder 51 from the six (6) fuel injection holes 71*a* respectively opened on both side of each fuel supply bar 71, the fuel F will be flowed toward the downstream side in the introducing cylinder 51, while being urged and turned by the compressed air A as shown in FIG. 8D. Therefore, if there is no deflector bar 72, such turned flows of the fuel F may tend to approach one another by counteraction and thus join together on the downstream side relative to the position corresponding to each deflector bar 72. Therefore, in such a case, there is a risk that the fuel F may not be adequately diffused. However, with the provision of the deflector bars 72 as described and shown in this embodiment, such a joining of the downstream flows of the fuel F can be successfully avoided. Namely, without any occurrence of uneven distribution or undue joining of the fuel F, the fuel F can be uniformly diffused in the introducing cylinder 51 and hence well mixed with the compressed air A flowed from above. Therefore, this embodiment can also provide the pre-mixed gas M3 uniformly containing the fuel F and compressed air A and thus exhibiting substantially less unevenness of the concentration of the fuel F. More specifically, in this third embodiment, as shown in FIG. 10B, which illustrates the distribution of concentration in the pre-mixed gas M3 around the outlet port 51*b* of the introducing cylinder 51, i.e., the outlet of the supplemental burner 40B, each first area P1 exhibiting the maximum concentration (e.g., 0.065) of the fuel F is quite small, and thus the distribution of concentration of the fuel F is made substantially uniform, compared with the distribution of the fuel concentration of the comparative example shown in FIG. 6B. Accordingly, this third embodiment can provide the premixed gas that can exhibit significantly less unevenness of the fuel concentration on the whole.

Figure 11:
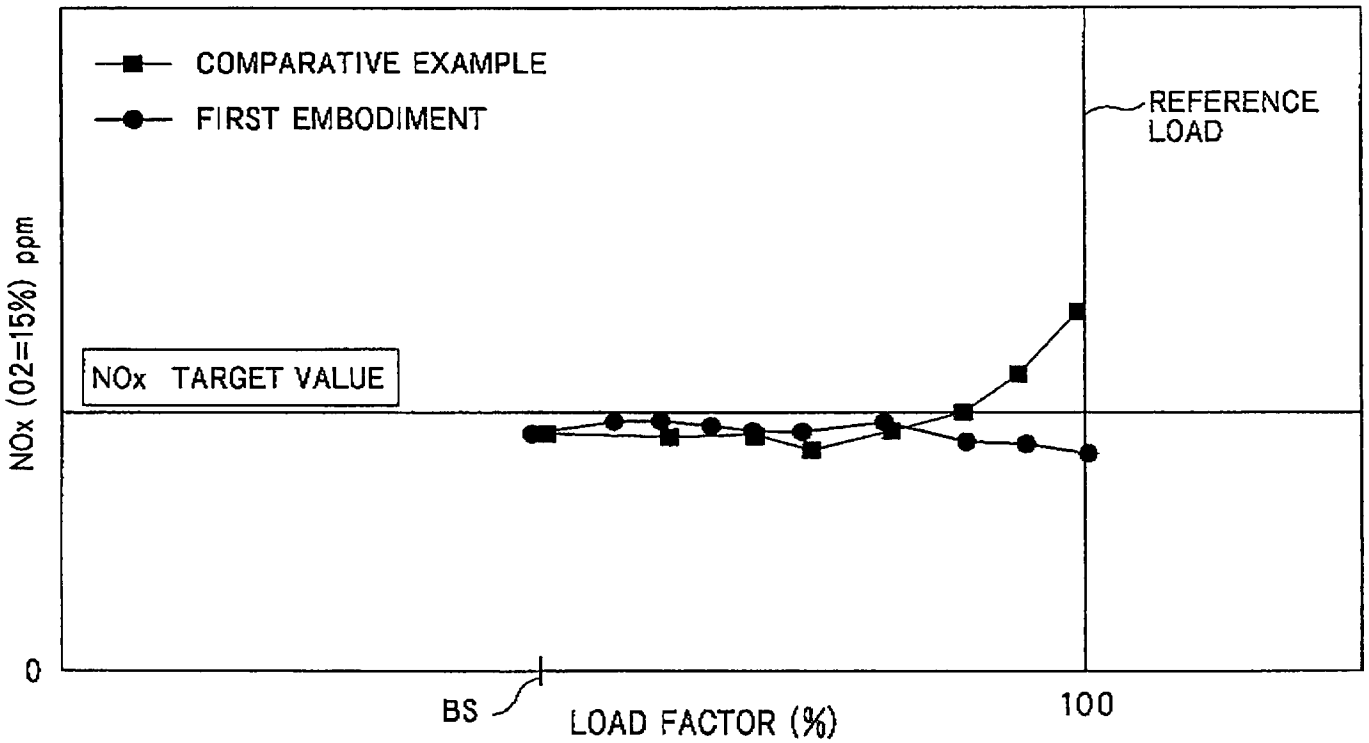
FIG. 11 is a graph showing results of a test on an engine for illustrating a relationship between the load factor and the NOx concentration in regard to the combustor using the supplemental burner related to the first embodiment of this invention and the combustor using the supplemental burner related to the comparative example.

FIG. 11 shows the results of the test on the engine, in regard to the combustor according to the first embodiment and the combustor according to the comparative example shown in FIG. 5, respectively provided in this engine. The horizontal axis of FIG. 11 designates the load factor, while the vertical axis of FIG. 11 designates the NOx concentration (in this case, the oxygen concentration in the air used for the combustion was 15%) at an outlet 10*e* (see FIG. 2) of the combustor cylinder 10. As shown in this drawing, in the case of the comparative example, the discharge amount of NOx, i.e., the NOx concentration, is gradually increased as the load factor approaches 100% from a point of time BS at which the supplemental burner is first operated. This NOx concentration is rapidly increased in the vicinity of the 100% load factor and exceeds a target or allowable value thereof. Meanwhile, in the case of the first embodiment, the NOx concentration is lower than the target value over all of the range of the load factor, and no marked increase of the NOx concentration is confirmed even when the load factor reaches 100%.

Figure 12:
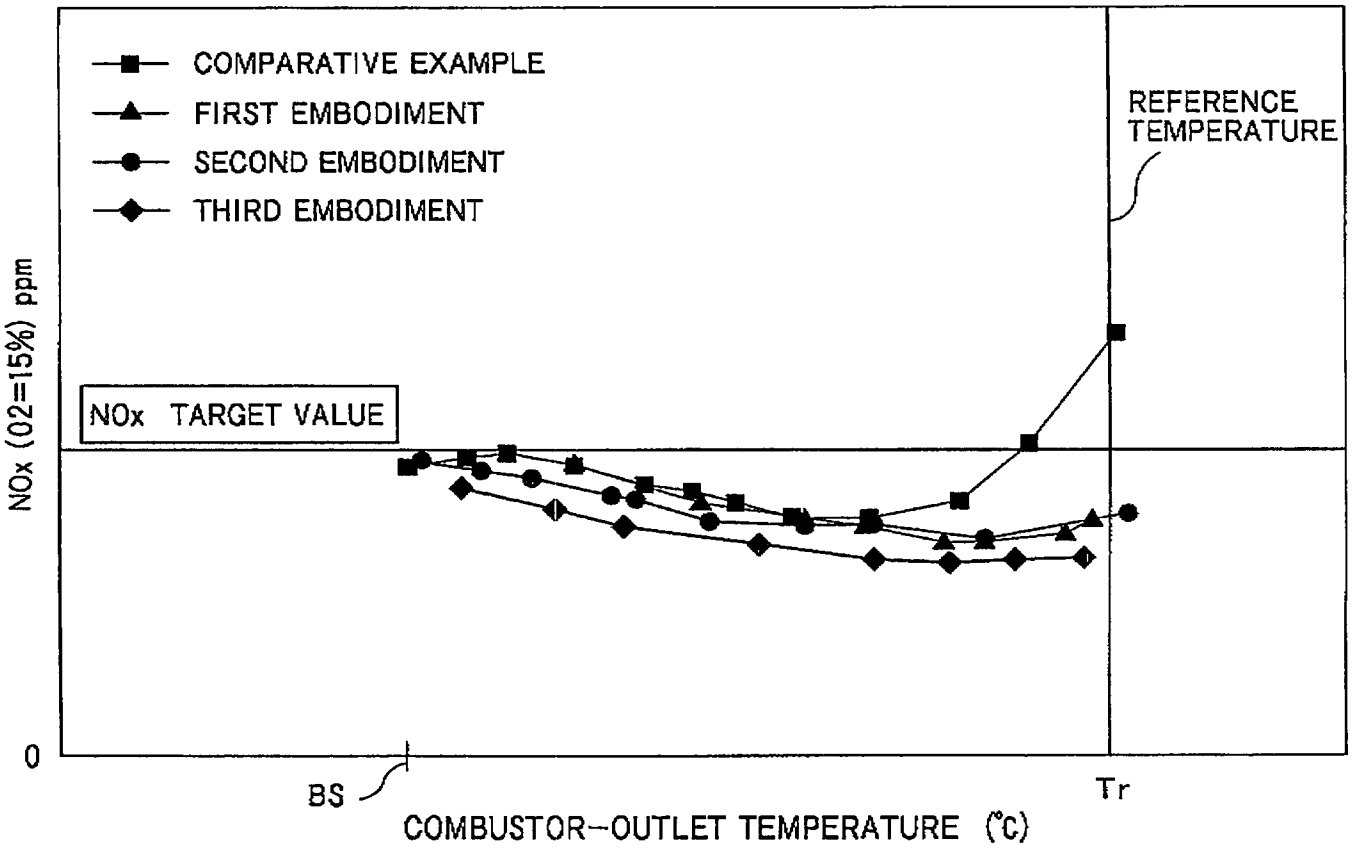
FIG. 12 is another graph showing results of a combustion experiment for illustrating a relationship between the temperature at the outlet of the combustor and the NOx concentration in regard to the combustor using each of the supplemental burners respectively related to the first to third embodiments of this invention and the combustor using the supplemental burner related to the comparative example.

FIG. 12 shows the results of the combustion experiment, in regard to the combustor using each of the supplemental burners respectively according to the first to third embodiments of this invention as well as the combustor using the supplemental burner according to the comparative example shown in FIG. 5. The horizontal axis of FIG. 12 designates the temperature of the combustion gas G at the outlet 10*e* of the combustor 10 shown in FIG. 2 (i.e., the combustor-outlet temperature). As shown in FIG. 12, in the case of the comparative example, the NOx concentration is conspicuously increased as the temperature in the combustor is increased and approaches a reference temperature Tr corresponding to the 100% load factor. Meanwhile, in any case of the first to third embodiments, the NOx concentration is lower than the target value, over all of the load factor range, and such a preferably lowered NOx concentration can be kept, even when the temperature reaches the reference temperature Tr.

It is noted that the inflow adjuster 76 of the introducing passage 50 may be eliminated as needed. In addition, the main burner 21 is not limited to the pre-mixing type burner as used in the above embodiments. For instance, a proper diffusion-type burner may be used as the main burner 21.

While several preferred embodiments have been described with reference to the drawings, it will be obvious to those skilled in the art that various changes and modifications of the present invention can be made without departing from the spirit and scope of this invention. Therefore, it should be construed that such changes and modifications also fall within the scope of the appended claims.

The invention claimed is:

1. A gas turbine combustor adapted for combusting a fuel together with a compressed air supplied from a compressor and supplying a combustion gas to a turbine, comprising:

a main burner provided to a head portion of a combustor cylinder constituting a combustion chamber; and a pre-mixing type supplemental burner provided to a downstream portion of the combustor cylinder relative to the main burner and extending through a circumferential wall of the combustor cylinder, wherein the supplemental burner comprises:

an introducing passage configured to deflect a part of the compressed air radially inward with respect to the combustor cylinder, the compressed air flowing from an air passage formed between the circumferential wall of the combustor cylinder and a housing surrounding the circumferential wall toward the head portion of the combustor cylinder, and introduce the compressed air into the combustor cylinder;

a fuel nozzle configured to supply the fuel from a plurality of fuel injection holes to the compressed air which is introduced into the introducing passage so as to produce a pre-mixed gas in the introducing passage;

an annular inlet port constituting an inlet of the introducing passage; and a plurality of guide pieces provided to the annular inlet port and configured to guide the compressed air toward a center of the inlet port; and wherein the fuel nozzle includes a nozzle plate constituting a head of the introducing passage, the fuel injection holes being provided in the nozzle plate such that the fuel is supplied into the introducing passage through the fuel injection holes and a space between each adjacent pair of the guide pieces.

2. The gas turbine combustor according to claim 1, wherein the supplemental burner further comprises a guide cylinder extending from the inlet port up to a downstream side relative to the guide pieces so as to constitute an outer wall forming an upstream part of the introducing passage.

3. The gas turbine combustor according to claim 1, wherein the supplemental burner further comprises an introducing cylinder attached to the combustor cylinder so as to constitute a downstream part of the introducing passage.

4. The gas turbine combustor according to claim 3, wherein a gap is provided between the guide cylinder and the introducing cylinder located on a downstream side relative to the guide cylinder.

5. The gas turbine combustor according to claim 1, wherein the introducing passage has an inlet passage area which is greater than an outlet passage area.

6. The gas turbine combustor according to claim 1, wherein the supplemental burner further comprises:

an annular inlet port constituting an inlet of the introducing passage; and an inflow adjuster configured to cover an outer circumference of the annular inlet port with a space therebetween.

* * * * *